United States Patent [19]

Jendrewski

[11] Patent Number: 4,563,729

[45] Date of Patent: Jan. 7, 1986

[54] DOUBLE-INSULATED, COMPACT, FOLDED FLUORESCENT TUBE FIXTURE

[75] Inventor: Alfons Jendrewski, Munich, Fed. Rep. of Germany

[73] Assignee: Patent-Treuhand-Gesellschaft fur Elektrische Gluhlampen mbH, Munich, Fed. Rep. of Germany

[21] Appl. No.: 624,596

[22] Filed: Jun. 26, 1984

[30] Foreign Application Priority Data

Jul. 18, 1983 [DE] Fed. Rep. of Germany ..... 3325840
Jul. 18, 1983 [DE] Fed. Rep. of Germany ... 8320650[U]

[51] Int. Cl.[4] ..... F21S 2/00

[52] U.S. Cl. ..... 362/218; 362/223; 362/294; 362/374

[58] Field of Search ..... 362/218, 223, 217, 260, 362/294, 84, 249, 345, 374

[56] References Cited

U.S. PATENT DOCUMENTS

| | | | |
|---|---|---|---|
| 2,710,336 | 6/1955 | Jorn | 362/218 |
| 3,171,945 | 3/1965 | Meng et al. | 362/345 |
| 3,183,346 | 5/1965 | Spaulding et al. | 362/218 |
| 3,419,714 | 12/1968 | Slauer | 362/218 |
| 3,647,148 | 3/1972 | Wince | 362/223 |
| 4,141,061 | 2/1979 | Ford et al. | 362/260 |
| 4,379,321 | 4/1983 | Plemmons et al. | 362/217 |
| 4,388,681 | 6/1983 | Meyer | 362/374 |
| 4,398,239 | 8/1983 | Vos et al. | 362/263 |

FOREIGN PATENT DOCUMENTS

| | | |
|---|---|---|
| 0012234 | 11/1979 | European Pat. Off. . |
| 2944967 | 5/1981 | Fed. Rep. of Germany . |

*Primary Examiner*—Magdalen Y. C. Moy
*Attorney, Agent, or Firm*—Frishauf, Holtz, Goodman & Woodward

[57] ABSTRACT

To provide for heat transmission of fluorescent tube accessory apparatus, a metal plate (16), for example of aluminum, is attached to the fixture structure which, otherwise, is entirely of plastic, having a base (3), a transparent closure cap (5) and an opaque cover cap (4). The caps (4) and (5), together with the base, define a chamber within which the lamp (2) is located, including the socket (6) thereof. Electrical accessory equipment (14) for the fluorescent lamp, for example starter, ballast and similar apparatus, is located against an internal support plate (15) which divides the chamber, the plate (15) having a reflective surface (22) facing the tube (2), and forming an attachment surface, at the same time, for the accessory apparatus (14). Plate (15) itself, is secured to support elements, such as posts and nipples (17, 20) extending from the support base interiorly of the chamber. All elements within the housing, thus, are double-insulated by the insulated housing structure itself.

17 Claims, 2 Drawing Figures

DOUBLE-INSULATED, COMPACT, FOLDED FLUORESCENT TUBE FIXTURE

Figure 1:
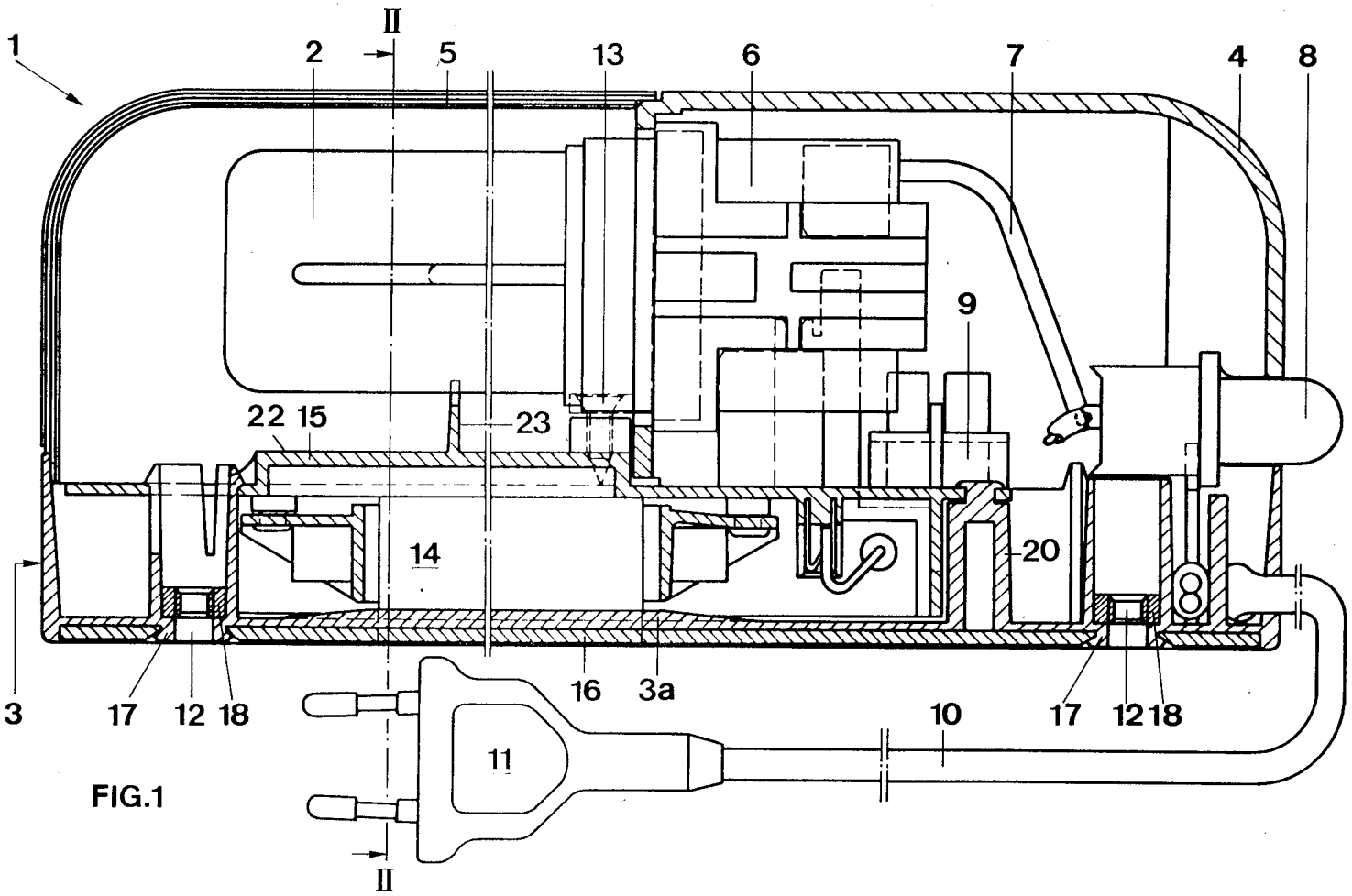

Reference to related applications, the disclosure of which is hereby incorporated by reference, assigned to the assignee of the present application: U.S. Ser. No. 352,720, filed Feb. 26, 1982, ALBRECHT et al. and now U.S. Pat. No. 4,481,442.

The present invention relates to a double-insulated, compact, folded fluorescent tube fixture, and more particularly to a fixture of this type suitable for use with small folded fluorescent lamps, for example of the type disclosed in the referenced application Ser. No. 352,720 now Pat. No. 4,481,442, which are single-ended and thus require only a single socket for their connection.

BACKGROUND

Various types of fixtures and holders for lamps have been proposed; if the light source is to be a fluorescent lamp, it is necessary to make provisions to place and electrically connect accessory equipment, such as starters, ballasts, and/or electronic control apparatus, for example apparatus which changes the frequency of operation of the power supplied to the lamp.

Only few types of lamp fixtures for folded, compact, single-ended fluorescent lamps have been made available. Table lamps have been proposed which include a narrow housing for the lamp, in which the electrical terminals such as sockets, connections and switches are enclosed. The lamp is positioned parallel to the longitudinal axis of the housing. The housing itself is connected by a carrier arm, for example a goose-neck, with a base which is sufficiently heavy to provide for stability. The accessory equipment used to start the lamp is located within the base, and the actual operating energy is supplied from the accessory equipment through the goose-neck to the lamp.

It has also been proposed to locate electrical components in a lamp housing—see, for example, German Patent Disclosure Document DE-OS No. 28 53 854, to which European Patent No. 12,234 corresponds. As described in this document, a metallic carrier structure is used which has sockets at its facing ends, connected to electrical connection lines. Accessory apparatus is located within the outline of the carrier structure. Electrical insulation is provided all around for the accessory apparatus in order to meet safety requirements and to insulate the electrical equipment from the metallic carrier.

In another type of light fixture, a table lamp has been proposed in which the housing for the light fixture is connected with a clamping element by a carrier arm. The clamping element is arranged to clamp the carrier arm, for example, to a table, shelf surface, or the like. The accessory equipment is located in a separate housing element.

THE INVENTION

It is an object to provide a unitary single lamp fixture, which includes all accessory structures, which is double-insulated to meet requirements without requiring a three-wire grounded outlet, which is simple to construct and is small in size; additionally, the lamp should be so arranged that it is capable of being located in an enclosed space, for example in a shelf area, within furniture, closets and the like, while still providing for radiation of heat generated within the lamp structure and/or the accessory equipment.

Briefly, an assembly of a support base of plastic material, an insulate cover cap of plastic material, and an insulated closure cap of transparent plastic material is provided, the cover cap and closure cap being fitted over the support base and defining therein an enclosed chamber which, at the outside, presents insulated surfaces. The fluorescent tube is located in the chamber beneath the transparent closure cap, and fluorescent tube operating accessory apparatus is located in the chamber and secured to the support base.

In accordance with a feature of the invention, heat which is generated in operation of the lamp and arising, for example, in the accessory apparatus, is transferred to a metallic carrier which is preferably located on the side of the base opposite the accessory apparatus, directly thereon or in a recess thereof. The metallic plate can be molded into the plastic carrier. The spacing between the accessory apparatus and the metallic plate should be as small as possible, just sufficient to permit a layer of plastic therebetween, insuring good heat transfer while providing excellent insulation. The metallic plate itself is merely a heat radiator and electrically not connected to any internal component. If desired, it may have an insulating coating applied thereover.

Figure 2:
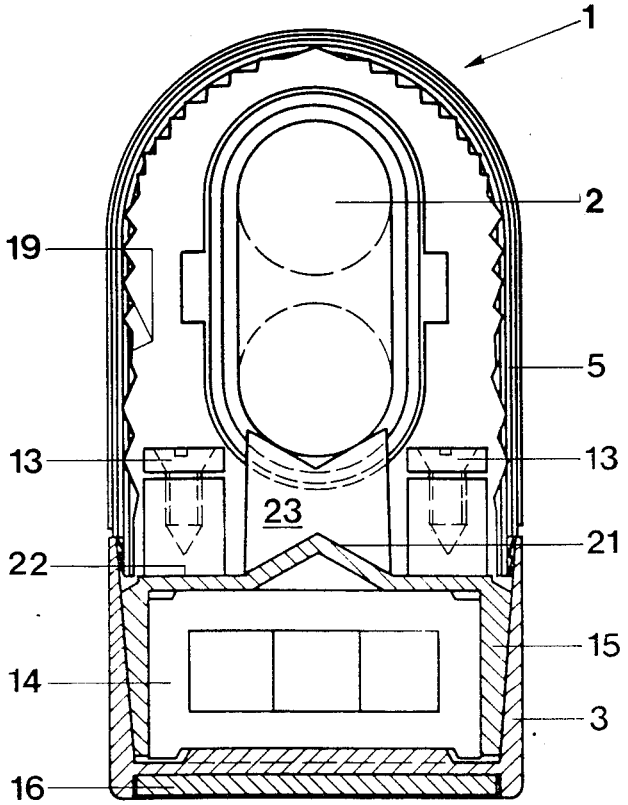

DRAWINGS:

FIG. 1 is a longitudinal sectional view through the fixture, with some elements shown only in side view and phantom representation; and FIG. 2 is a cross-sectional view along line II—II of FIG. 1, illustrating the lamp only in schematic representation.

The housing for the fixture 1 encloses a compact, single-based, folded fluorescent lamp 2, for example of the type described in the aforementioned referenced ALBRECHT et al. application Ser. No. 352,720. The lamp base is fitted into a socket 6. The fixture 1 is an assembly formed of a base or support element 3, a transparent plastic closure cap 5, beneath which the lamp 2 is located, and a plastic cover end cap 4. The closure cap 5 and the cover end cap 4 are suitably connected to the housing, for example by snap connections, which may include tongue-and-groove or projection-and-recess connections, not specifically shown and well known in snap-together connection of slightly resilient plastic parts. The cap 4 additionally is secured to the support element 3 by screws 13. All electrical connections are located beneath the cap 4; they include the socket 6 for the lamp, internal electrical connections 7, only schematically shown, a switch 8, and internal connecting terminals 9. If a cable 10 is desired, it is carried out through an external opening, for example formed as a knock-out in the carrier 3, the cable 10 having a plug 11. Only two terminals are needed, since the structure is double-insulated. The fixture 1 can also be wired in permanently, for example to a cable connected to the electrical power network. If so, the opening for the cable 10 is not used, for example by leaving a knock-out undisturbed and, instead, a knock-out in the bottom of the carrier element 3 can be opened, for connection of a permanently wired cable to the terminal posts 9. All electrical connection terminals are covered by the base structure 3 and the cap 4, both of which are made of opaque plastic material. Knock-outs or openings 12 are formed in the carrier structure 3 in order to permit the fixture 1 to be mounted. Access from the interior of the fixture to the openings 12 is provided from the inside thereof, upon removal of the caps 4 and 5.

The lamp 2, when inserted in the socket 6, extends parallel to the support base structure 3. The accessory apparatus, including, for example, a starter, ballast, radio suppression apparatus, a frequency conversion circuit or the like, in general shown as a block 14, and usually encapsulated itself, is located beneath the portion of the support base 3 extending parallel to the lamp 2. The support base 3 includes a holding plate 15. For initial attachment, the accessory equipment block 14 is connected to the holding plate 15, for example by rivets or the like, and then the holding plate 15 is assembled with the support base 3. The upper side of the holding plate 15 is coated or made of a bright material to be reflective, to form a reflector for the lamp 2; it is securely connected to the support base 3, for example by plastic welding after a snap-in connection is formed with a post 20 molded on the support structure 3.

The plate 15 is preferably formed with a roof-shaped or inverted V-shaped center portion 21 (FIG. 2) on which the reflective surface 22 is applied. The plate 15, further, carries upstanding support brackets 23 which are formed, upwardly, with a V-notch so that the tubular portion of the fluorescent lamp 2 can fit therein—see FIG. 2.

A metal plate 16, for example made of aluminum, is fitted into the outside of the bottom surface of the support base structure 3. The metal plate 16 is set into a recess within the base structure 3, and secured in position, for example by plastic nipples 17 which, after insertion and, for example, snap-in connection as best seen on the left-side nipples (FIG. 1) 17, are deformed at the outside by heat or ultrasonic vibration. Alternatively, the plate 16 can be inserted into the carrier structure 3 upon molding thereof and entirely embedded and encapsulated within plastic material. The layer of plastic material of the cap 3 opposite the plate 16 is sufficiently thick to provide for reliable insulation at operating and surge voltages; the plastic bottom of the structure 3 may be slightly thickened beneath the accessory equipment 14, as seen at 3*a* (FIG. 1) to insure integrity of the insulation opposite that element which requires support as well as effective insulation and good heat transfer to the plate 16.

The fixture 1 can readily be mounted on a wall, a shelf unit, or within furnitute. The openings 12 which, preferably, extend centrally through the nipples 17, permit mounting of the fixture on a shelf, base or other structure after removal of the caps 4, 5, to provide access from the inside of the lamp to the opening. The lamp can also be mounted by external screws passing through the openings 12 and engaging nuts 18 seated in the interior of the nipples 17. These nuts 18 can be removable, for example of external hexagonal shape, and fitted into hexagonal inside walls of the nipples 17. Initially, and upon manufacture, the nuts 18 are preferably slightly press-fitted, or molded in the plastic of the nipples 17, to insure their reliable seating and permit engagement by external screws passing through the nipples 17. Indirect mounting, for example by means of additional holders such as holding brackets can also be secured to the carrier structure 3 and connected to the fixture by screws passing through the nuts 18.

The compact fluorescent lamp 2 has a discharge portion which is formed of two parallel connected leg parts; it is completely enclosed and covered by the transparent cap 5 which, by suitable snap-in construction, can be easily made so that it can be pushed together against cap 4, and snapped on the base structure 3. In operation, thus, the lamp is completely enclosed, and all internal connectors, which are inherently insulated, are again double-insulated from the outside by the plastic enclosure formed by the base structure 3, and caps 4, 5. Yet, if desired, and for mounting and assembly, the caps can be removed.

Light distribution from the lamp unit 1 is enhanced by forming the transparent cap 5 with an internal ribbing 19 (FIG. 2), which can be suitably shaped to provide prismatic effects and insure uniform light distribution. Lateral distribution is enhanced by the reflective surface 22 on the V-shaped central portion 21 of the plate 15 of base structure 3.

The lamp, thus, meets the safety requirements of "double-insulated" electrical equipment, and special insulation as well as extra additional encapsulation of the accessory equipment 14 is not necessary. The metal plate 16 provides for excellent heat radiation from the fixture, so that the temperature of the fixture at the attachment surface, even in confined spaces having no, or only minimum air circulation, will not exceed the limiting temperature of 95° C., of high-temperature operating equipment. The accessory equipment 14, itself, may reach a higher temperature; the overall temperature of the unit, however, will not. Thus, the fixture can be installed in confined spaces, for example within closets, furniture, or the like.

The metal plate 16 is located on the carrier essentially in alignment with the accessory equipment 14; it is secured to the carrier directly or, preferably, recessed therein. The mode of attachment of the metal plate can be selected as desired, and the metal plate need not be attached by the rivets 17, although this is a very simple, inexpensive and hence preferred arrangement; screw connection, adhesion and riveting connection may also be used; alternatively, the outer walls of the base structure 3 can be formed with a dovetail-type recess, within which the plate can snap.

In accordance with a feature of the invention, the plate may be directly molded or injection-molded upon molding the carrier structure which forms the entire plastic element 3. This, then, eliminates manufacturing steps in specifically placing and assembling the plate 16 to the carrier structure 3. The distance between the accessory block 14 and the metal plate should be as small as is consistent with insulation requirements to provide good heat transfer from the equipment 14 to the plate 16.

The metal plate, which is substantially larger than the accessory block 14, will uniformly distribute heat generated within the unit 14, and permit for radiation thereof over a large surface area. Consequently, the outer temperature of the fixture will be substantially lower than that of the accessory equipment block 14 itself. Experiments have shown that no point of the fixture in the region of attachment thereof exceeds 95° C., which is a maximum temperature for some classes of insulation material. Slight air circulation beneath the plate 16 may be desirable; if so, the end walls of the structure 3 at the left side, and of the cap 4 at the right side—with respect to FIG. 1, can be carried out just below the plate 16 to provide for a clearance space, with suitable ventilation notches formed in the end wall. Alternatively, small adhesive tabs, for example of resilient heat-resistant foam material, can be applied to the outside of the plate 16, or a plastic coating thereof, which, at the same time, can form attachment elements.

Various changes and modifications may be made, and any features described herein may be used with any of the others within the scope of the inventive concept.

When the entire bottom surface of the carrier element 3 is covered by the plate 16 ( maximum size), a thickness of 0.3 mm is sufficient for dissipating enough heat.

The minimum dimensions of the plate 16 are determined by the size of the accessory apparatus 14. In this case, however, the thickness of plate 16 has to be increased accordingly to ensure sufficient heat dissipation.

In our example, the plate 16 covers the entire bottom surface of the carrier element 3 and has a thickness of about 1.5 mm. This ensures in each case that the temperature at all the outer surfaces of the fixture will not exceed 95° C.

I claim:

1. Double-insulated, compact folded fluorescent tube fixture having a folded fluorescent tube (2);

fluorescent tube operating accessory apparatus (14);

and electrical terminal devices (9, 11), comprising an assembly of a support base (3) of plastic material, an insulated cover cap (4) of plastic material and a closure cap (5) of transparent plastic material, the cover cap (4) and the closure cap (5) being fitted over the support base (3) and defining therewith an enclosed chamber;

the fluorescent tube being located in the chamber beneath the transparent closure cap (5), and the fluorescent tube operating accessory apparatus (14) being located in said chamber, and secured to the support base of plastic material; and a metal plate (16) secured to the support base and located at a region thereof outside of said chamber to dissipate heat generated in operation of the lamp within the accessory apparatus (14), wherein the region of the support base (3) opposite the fluorescent tube accessory apparatus (14) is thickened with respect to the remaining portion of the support base to provide for increased electrical insulation between the accessory apparatus (14) and the metal plate (16) fitted against the outside of the support base.

2. Fixture according to claim 1, further comprising an attachment plate (15) aecured to the support base (3), said accessory apparatus (14) being attached to and supported by said attachment plate (15).

3. Fixture according to claim 2, wherein the attachment plate (15) is located within the chamber in essential alignment with the folded fluorescent tube (2), and is formed with a reflective surface (22) on the side thereof facing the fluorescent tube.

4. Fixture according to claim 1, wherein the cover cap (4) and the closure cap (5) are removably, releasably secured to the support base (3).

5. Fixture according to claim 1, wherein the transparent closure cap (5) is formed, internally, with light distribution prisms (19).

6. Fixture according to claim 1, further including an internal support plate (15) secured to the support base (3);

and wherein the accessory apparatus (14) is secured to and supported by said support plate;

and internally extending support elements (17, 20) connecting the support plate (15) and the support base.

7. Fixture according to claim 6, wherein the support plate (15) is formed with a V-shaped light distribution zone in the region thereof beneath the fluorescent tube (2).

8. Fixture according to claim 7, wherein the surface (22) of the support plate (15) facing the fluorescent tube is reflective.

9. Fixture according to claim 6, further including support brackets (23) extending from the support plate (15) and having a V-groove engaging and supporting the fluorescent tube (2).

10. Fixture according to claim 6, wherein said support plate (15) is of plastic material.

11. Double-insulated, compact, folded fluorescent tube fixture having a folded fluoresent tube (2), fluorescent tube operating accessory apparatus (14) and electrical terminal devices (9), and comprising, in accordance with the invention, an assembly of a support base (3) of plastic material;

an insulated cap structure (4, 5) of plastic material, the cap structure being, at least in part, transparent in the region in alignment with the folded fluorescent tube, and defining with the support base (3) an enclosed chamber;

and a metal plate (16) secured to the support base and electrically insulated from the fluoresent tube operating accessory apparatus (14) to provide for heat distribution and transfer from the accessory apparatus (14), said metal plate being substantially larger in areal extent than the areal extent of the accessory apparatus, wherein the metal plate (16) is located against the support base (3) at the surface thereof outside of said chamber.

12. Fixture according to claim 11, wherein the support base (3) is formed with a recessed region outside of the chamber, the metal plate (16) being located within said recess.

13. Fixture according to claim 11, wherein said metal plate (16) is molded into the support base.

14. Fixture according to claim 11, wherein said metal plate (16) comprises an aluminum plate.

15. Fixture according to claim 1, wherein the support base (3) is formed with a recessed region outside of the chamber, the metal plate (16) being located within said recess.

16. Fixture according to claim 1, wherein said metal plate (16) is molded into the support base.

17. Fixture according to claim 1, wherein said metal plate (16) comprises an aluminum plate.

* * * * *